US011530496B2

(12) United States Patent
Pohn et al.

(10) Patent No.: US 11,530,496 B2
(45) Date of Patent: Dec. 20, 2022

(54) SPINNING MACHINE COMPRISING A PLURALITY OF ADJACENTLY ARRANGED WORKSTATIONS AND A DISPLACEABLE MAINTENANCE UNIT WITH A PNEUMATIC WORKING ELEMENT AND METHOD FOR SUPPLYING THE PNEUMATIC WORKING ELEMENT WITH VACUUM

(71) Applicant: Maschinenfabrik Rieter AG, Winterthur (CH)

(72) Inventors: Romeo Pohn, Geisenfeld/Rottenegg (DE); Harald Widner, Ingolstadt (DE); Sebastian Fritz, Dietfurt (DE); Simon Schoenberger, Ingolstadt (DE)

(73) Assignee: Maschinenfabrik Rieter AG, Winterthur (CH)

( * ) Notice: Subject to any disclaimer, the term of this patent is extended or adjusted under 35 U.S.C. 154(b) by 52 days.

(21) Appl. No.: 16/945,882

(22) Filed: Aug. 2, 2020

(65) Prior Publication Data

US 2021/0032781 A1 Feb. 4, 2021

(30) Foreign Application Priority Data

Aug. 2, 2019 (DE) ..... 10 2019 120 980.3

(51) Int. Cl.
*D01H 11/00* (2006.01)
*D01H 5/68* (2006.01)
*D01H 4/36* (2006.01)

(52) U.S. Cl.
CPC ..... *D01H 11/005* (2013.01); *D01H 5/68* (2013.01); *D01H 4/36* (2013.01)

(58) Field of Classification Search
CPC .. D01H 4/48; D01H 4/50; D01H 4/52; D01H 11/005; D01H 11/006; D01H 13/005; D01H 15/013
See application file for complete search history.

(56) References Cited

U.S. PATENT DOCUMENTS 3,540,201 A * 11/1970 Shinkai ..... D01H 4/50 57/263
4,058,963 A 11/1977 Stahlecker
(Continued)

FOREIGN PATENT DOCUMENTS

DE 102 05 786 A1 9/2002
DE 101 39 078 A1 2/2003
(Continued)

OTHER PUBLICATIONS

EPO Search Report, dated Dec. 22, 2020.
German Patent Office Search Report, dated Jul. 28, 2020.

*Primary Examiner* — Shaun R Hurley
*Assistant Examiner* — Patrick J. Lynch
(74) *Attorney, Agent, or Firm* — Dority & Manning, P.A.

(57) ABSTRACT

A spinning machine and method of operation include a plurality of adjacently arranged workstations, each workstation having one of a spinning device or a suction nozzle to which a process vacuum is applied during spinning operation. A vacuum duct extends along the workstations for supplying the spinning devices or the suction nozzles with the process vacuum. A maintenance unit is displaceable along the workstations, the maintenance unit including a pneumatic working element and a vacuum line to supply the pneumatic working element with vacuum. A closeable connection opening is at each of the spinning devices or the suction nozzles, the connection opening connected to the process vacuum. The maintenance unit includes a suction head that is advanceable toward the connection opening and is connected to the vacuum line.

21 Claims, 6 Drawing Sheets

(56) References Cited

U.S. PATENT DOCUMENTS

| | | | | | |
|---|---|---|---|---|---|
| 4,246,749 | A | * | 1/1981 | Mikulecky | D01H 4/50 57/263 |
| 4,485,616 | A | | 12/1984 | Morita et al. | |
| 4,676,059 | A | * | 6/1987 | Artzt | D01H 4/48 57/263 |
| 5,640,838 | A | * | 6/1997 | Billner | D01H 4/50 57/263 |
| 5,694,756 | A | * | 12/1997 | Lindner | D01H 4/50 57/263 |
| 5,867,975 | A | * | 2/1999 | Breitenhuber | D01H 4/50 57/413 |
| 2019/0119063 | A1 | * | 4/2019 | Hagi | B65H 51/10 |
| 2019/0233980 | A1 | * | 8/2019 | Schloemer | B65H 54/22 |
| 2019/0257007 | A1 | * | 8/2019 | Kuebler | D01H 4/12 |
| 2020/0391975 | A1 | * | 12/2020 | Stephan | D01H 11/005 |

FOREIGN PATENT DOCUMENTS

| | | | |
|---|---|---|---|
| DE | 10 2005 017579 | A1 | 12/2005 |
| DE | 10 2004 038 697 | A1 | 2/2006 |
| EP | 3 363 757 | A1 | 8/2018 |

* cited by examiner

SPINNING MACHINE COMPRISING A PLURALITY OF ADJACENTLY ARRANGED WORKSTATIONS AND A DISPLACEABLE MAINTENANCE UNIT WITH A PNEUMATIC WORKING ELEMENT AND METHOD FOR SUPPLYING THE PNEUMATIC WORKING ELEMENT WITH VACUUM

FIELD OF THE INVENTION

The present invention relates to a spinning machine, in particular an open-end spinning machine, comprising a plurality of adjacently arranged workstations that each include a spinning device to which a process vacuum can be applied. At least one vacuum duct extends along the workstations for supplying the spinning devices with the process vacuum. At least one maintenance unit is displaceable along the workstations and includes at least one pneumatic working element and at least one vacuum line for supplying the pneumatic working element with vacuum.

BACKGROUND

Open-end spinning machines comprising displaceable maintenance units are known from the prior art. The maintenance units generally comprise multiple working elements, which can carry out various maintenance tasks at the individual spinning stations, such as a package change, rotor cleaning, piecing after a thread break or after a package change, and the like. The maintenance units and/or their working elements must therefore be supplied with electrical energy, with vacuum, and/or with compressed air depending on the design of their working elements. Various systems for supplying the working elements of the maintenance units with vacuum have become known.

From DE 102 05 786 A1 it is known, for example, to arrange a vacuum source for the maintenance unit in the form of a vacuum pump directly on the displaceable maintenance unit. The vacuum pump has a correspondingly high space requirement and a correspondingly high weight, which must always be carried along with the maintenance unit. If numerous working elements of the maintenance unit must be supplied with vacuum, moreover, the output of such a vacuum pump, which is displaceable with the maintenance unit, may possibly not be sufficient.

Spinning machines have therefore gained acceptance, which, in addition to their regular vacuum system, which provides the process vacuum, comprise a further vacuum system, which supplies vacuum to the maintenance unit. Such a spinning machine is shown in DE 10 2004 038 697 A1. The spinning machine comprises a first ventilator for this purpose, which applies vacuum to a first vacuum duct, via which the workstations of the spinning machine are supplied with process vacuum. A second vacuum duct extends above the spinning machine, which is acted upon by a second ventilator, via which the maintenance unit is supplied with vacuum. The vacuum supply of the machine is therefore complex.

Spinning machines are being manufactured to an increasing extent, however, which comprise so-called autonomous workstations, which can carry out the necessary maintenance actions predominantly automatically with the aid of working elements arranged at the spinning stations. A displaceable maintenance unit is still necessary for the package change, however. DE 101 39 078 A1 proposes, with respect to such a machine, to dispense with a vacuum supply for the maintenance unit. In this case, the maintenance unit merely provides an auxiliary thread for piecing. The further tasks are carried out by workstation-specific working elements. There are still cases, however, in which maintenance actions must be carried out by a displaceable maintenance unit.

The problem addressed by the present invention is therefore that of ensuring the vacuum supply of the maintenance unit in an easy way.

SUMMARY

The problem is solved with the aid of a device and a method having the features described and claimed herein. Additional objects and advantages of the invention will be set forth in part in the following description, or may be obvious from the description, or may be learned through practice of the invention.

A spinning machine, in particular an open-end spinning machine, comprising a plurality of adjacently arranged workstations, which each include a spinning device to which a process vacuum can be applied, includes at least one vacuum duct extending along the workstations for supplying the spinning devices with the process vacuum. Alternatively or additionally, the workstations can also comprise a suction nozzle to which a process vacuum can be applied. For example, on air-jet spinning machines, such a suction nozzle at each workstation is associated with a drafting system. In the case of rotor spinning machines comprising so-called autonomous workstations, on the other hand, suction nozzles are frequently provided at the workstations in order to seek a thread end, which is to be newly pieced, on a delivery bobbin. Moreover, the spinning machine comprises at least one maintenance unit, which is displaceable along the workstations and which includes at least one pneumatic working element and at least one vacuum line for supplying the pneumatic working element with vacuum. It is provided that the spinning devices each comprise a closeable connection opening, which is connected to the process vacuum. Alternatively or additionally, the suction nozzles can also each comprise such a closeable connection opening. Moreover, the maintenance unit comprises a suction head, which can be advanced toward the connection opening of the spinning devices and/or the suction nozzles and which is connected to the vacuum line. The closure of the connection opening can take place with the aid of a cover element or also only with the aid of a valve.

In a method for supplying a pneumatic working element of a maintenance unit of a spinning machine with vacuum, the spinning machine comprises a plurality of adjacently arranged workstations, which each include a spinning device to which a process vacuum can be applied and/or include a suction nozzle to which a process vacuum can be applied. The maintenance unit is displaceable along the workstations. With respect to the method, it is therefore provided that the working element is supplied with process vacuum with the aid of a suction head of the maintenance unit, wherein the suction head is advanced toward a closeable connection opening of the spinning device and/or the suction nozzle.

In contrast to the prior art, the vacuum supply is therefore now brought about with the aid of the vacuum system, which is present anyway and which provides the process vacuum. The structural outlay for such a spinning machine is therefore substantially less and the spinning machine can be manufactured substantially more cost-effectively. All that is necessary are connection openings at the individual spinning devices or suction nozzles, which can be introduced into a housing of the spinning device in a structurally simple way. It is also possible to utilize existing openings as connection openings.

The supply of the maintenance unit with the process vacuum via a connection opening arranged at the workstation is advantageous, in particular, in the case of spinning machines including autonomous workstations. These machines require vacuum only for a few maintenance actions. The vacuum can therefore be withdrawn easily and in a sufficient quantity directly at the spinning device, without adversely affecting the vacuum system of the machine.

It is advantageous when the spinning device is designed as a rotor spinning device comprising a rotor housing. This type of vacuum supply can be particularly advantageously utilized at a rotor spinning machine. It is also conceivable, however, to supply the maintenance unit of a friction spinning machine with vacuum in this way.

Alternatively, it is also advantageous, however, when the spinning device is designed as an air-jet spinning device comprising a spinning chamber to which the process vacuum can be applied. In this case, the maintenance unit can be supplied with vacuum via a connection opening of the spinning device close to the spinning chamber or also via a connection opening of a suction nozzle.

Moreover, it is advantageous when the connection opening is an opening of the rotor housing that is closeable with the aid of a cover element. With respect to the method, in the case of a spinning device designed as a rotor spinning device comprising a rotor housing, the working element is therefore advantageously supplied with process vacuum via an opening of the rotor housing. The rotor housing comprises an opening anyway that is closeable with the aid of a cover element and that allows for the cleaning of the spinning rotor, the replacement of the spinning rotor, and the cleaning of the rotor housing itself. During the spinning operation, this opening is closed with the aid of the cover element. Therefore, no additional components are necessary in order to supply the maintenance unit with the vacuum, and so this can be brought about particularly easily and cost-effectively.

It is also advantageous when the suction head is movable out of a neutral position into a working position in order to be advanced toward the connection opening. As a result, the maintenance unit can easily move along the workstations, without this resulting in the risk of collisions with the suction head. In addition, as a result, the suction head can then be advanced exclusively toward the particular connection opening when vacuum is also actually needed. An unnecessary opening and closing of the connection openings when the maintenance unit passes by can be avoided as a result.

It is also advantageous when the suction head in the working position completely covers the connection opening, in particular the opening of the rotor housing. As a result, the connection opening can be particularly easily sealed toward the outside, so that vacuum losses are avoided.

In order to seal the connection opening, in particular the opening of the rotor housing, toward the outside in the working position of the suction head, it is advantageous when the suction head cooperates with a sealing element of the spinning device. In particular, this is advantageous when the connection opening is the opening of the rotor housing, since this is usually provided with a sealing element anyway, which cooperates with the cover element of the rotor housing during the operation of the workstation.

With respect to the method, it is therefore advantageous when the connection opening is sealed toward the outside with the aid of a sealing element, in particular with the aid of a sealing element of the connection opening, during the supply of the working element with the process vacuum.

Alternatively, it is also possible, however, that the suction head comprises a sealing element, which seals the connection opening toward the outside and/or, in the case of the method, the connection opening is sealed with the aid of a sealing element of the suction head during the supply of the working element with the process vacuum. In this way, it is conceivable, for example, that the sealing element of the spinning device is not arranged at the rotor housing, but rather at the cover element. In this case, it is advantageous to equip the suction head with a sealing element. Moreover, it is also advantageous to equip the suction head with a sealing element when a connection opening is provided that differs from the opening of the rotor housing that is present anyway. In this case, every single connection opening then does not need to be provided with a sealing element; instead, it is sufficient to arrange a single sealing element at the suction head. If, for example, the connection openings are provided in the suction nozzles, it would be conceivable to arrange the sealing element at the suction head.

It is also advantageous when the suction head comprises a centering element, with the aid of which the suction head can be centered with respect to the connection opening. The connection of the suction head to the connection opening as well as the sealing toward the outside are facilitated as a result. The centering element can be easily designed, for example, as a centering cone, which can be introduced into a cylindrical connection opening.

Moreover, it is advantageous when the suction head comprises a cover element, which covers a spinning rotor arranged in the rotor housing in the working position of the suction head. As a result, the spinning rotor is protected against damage by the suction head and against contamination and fiber fly, which can result during individual maintenance actions. With respect to the method, it is also advantageous when the spinning rotor is covered by a cover element of the suction head during the supply of the working element with the process vacuum.

It is particularly advantageous when the pneumatic working element is a sliver feeding device or at least one component, in particular a suction tube, of a sliver feeding device. Sliver feeding devices are known from the prior art, which, after a breakage or a changeover of the fiber material fed to the spinning device, pick up a sliver end from a can and feed it to the feeding device or to the drafting system of the spinning device again. With respect to the method, it is advantageous when a sliver end is picked up and fed to a feeding device or to a drafting system of the spinning device with the aid of the pneumatic working element.

In contrast to many other maintenance actions, such an application of the sliver is a comparatively rarely carried-out maintenance action, and so it can be reasonably and economically carried out by a displaceable maintenance unit. In this case, it is also advantageous when, as mentioned at the outset, all or at least a better part of the further maintenance actions are/is carried out by working elements of the individual workstations themselves.

It is also advantageous when the cover element comprises a passage opening, which, in the working position of the suction head, connects the vacuum line of the maintenance unit to a suction opening of the rotor housing. As a result, it is possible to also convey materials through the suction head with the vacuum flow. In this way, for example, in the case of a sliver feeding device, a detached sliver piece can be easily guided, via the vacuum line and through the passage opening of the suction head, into the connection opening, and can be disposed of via the vacuum duct. If the connection opening is the opening of the rotor housing, the detached sliver piece can be sucked past the rotor into the vacuum duct, without getting tangled at the rotor or contaminating the rotor. For this purpose, the cover element completely covers the spinning rotor. Preferably, the cover element nearly completely fills the rotor housing and leaves only the passage opening exposed.

With respect to the method, it is therefore advantageous when the picked-up sliver end is trimmed before being fed to the spinning device, in particular to a feeding device or a drafting system of the spinning device, wherein a detached sliver piece arises.

Moreover, it is advantageous in this case when the detached sliver piece is extracted via the suction head and the connection opening and is disposed of.

With respect to a rotor spinning machine, it is particularly advantageous when the detached sliver piece is extracted via the opening of the rotor housing and a suction opening of the rotor housing and is disposed of. The suction opening of the rotor housing is present anyway, in order to apply vacuum to the rotor housing and is usually also provided with a valve anyway, so that the vacuum supply can also be shut off.

Alternatively, it is possible, however, not to dispose of the detached sliver piece via the suction head and the connection opening, but rather to deposit it in a collection container. For this purpose, for example, the detached sliver piece can be deposited in a collection container with the aid of the pneumatic working element or possibly with the aid of a further handling element, which does not necessarily need to be pneumatic.

Preferably, multiple detached sliver pieces are initially gathered in the collection container.

In order to dispose of the detached sliver piece or the multiple collected sliver pieces, it is advantageous when this or these are transported to a machine end. The detached sliver piece(s) can be deposited, at the machine end, for example, in an empty can, or are transferred to a transport vehicle. In this case, it is possible to transport a detached sliver piece directly to the machine end. It is also possible, however, to transport multiple sliver pieces, which have been gathered in the collection container, jointly from time to time, to the machine end. The transport to the machine end can take place, for example, with the aid of a trash conveyor belt, which is present anyway.

According to one further advantageous embodiment of the method, the detached sliver piece is fed to a trash conveyor belt, in order to dispose of it. Directly after the trimming, the sliver piece can be deposited onto the trash conveyor belt with the aid of the pneumatic working element or, possibly, also a further handling element. It is also conceivable, however, to feed multiple sliver pieces, which have been gathered in the above-described collection container, jointly to the trash conveyor belt from time to time.

BRIEF DESCRIPTION OF THE DRAWINGS

Further advantages of the invention are described in the following exemplary embodiments. Wherein.

DETAILED DESCRIPTION

Figure 1:
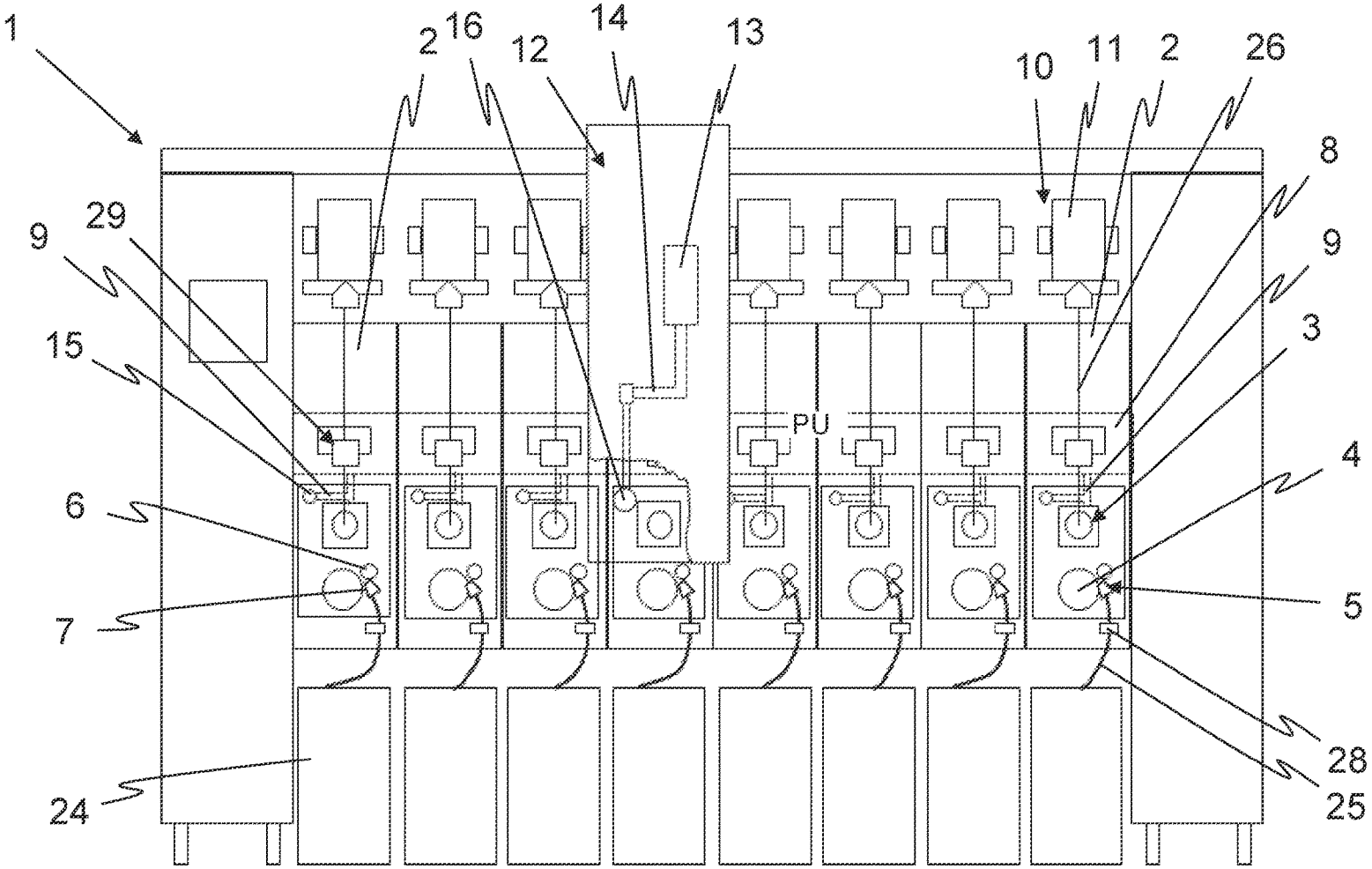
FIG. 1 shows a front view of a spinning machine in a schematic overview representation.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

In the following description of the figures, the same reference numbers are utilized for features that are identical or at least comparable in each of the individual embodiments or the individual figures. Some of the features are therefore explained only upon the first mention thereof or only once with reference to a suitable figure. Provided these features are not explained once more separately in connection with the further features, their design and/or mode of operation correspond(s) to the design and mode of operation of the identical or comparable, described features. For the sake of clarity, in the case of multiple identical features or components in a figure, only one feature or only a few of these identical features is/are labeled.

FIG. 1 shows a front view of a spinning machine 1 in a schematic representation. The spinning machine 1 comprises a plurality of adjacently arranged workstations 2, at which a sliver 25 is spun into a yarn 26 in a way known per se. For this purpose, each of the workstations 2 comprises a feeding device 5, to which the sliver 25 is supplied from a can 24. In order to avoid the formation of loops in the sliver 25 and/or to undo existing loops, the sliver 25 can be guided through a loop-catching means 28 arranged at the workstation 2. The feeding device 5 contains, in the present case, a driven feed roller 6 and a feed trough 7, which feed the sliver 25 to an opening roller 4. From there, the fiber material opened into individual fibers is fed to a spinning device 3, where it is spun into the yarn 26. The yarn 26 is drawn out of the spinning device 3 with the aid of a take-off device 29 and is fed to a winding device 10, where it is wound onto a package 11.

In order to spin the sliver 25, the spinning device 3 requires a process vacuum PU, which is supplied to the individual workstations 2 via a vacuum duct 8 extending along the workstations 2. The process vacuum PU is applied to each of the spinning devices 3 through a tap line 9 branching off from the vacuum duct 8.

Figure 7:
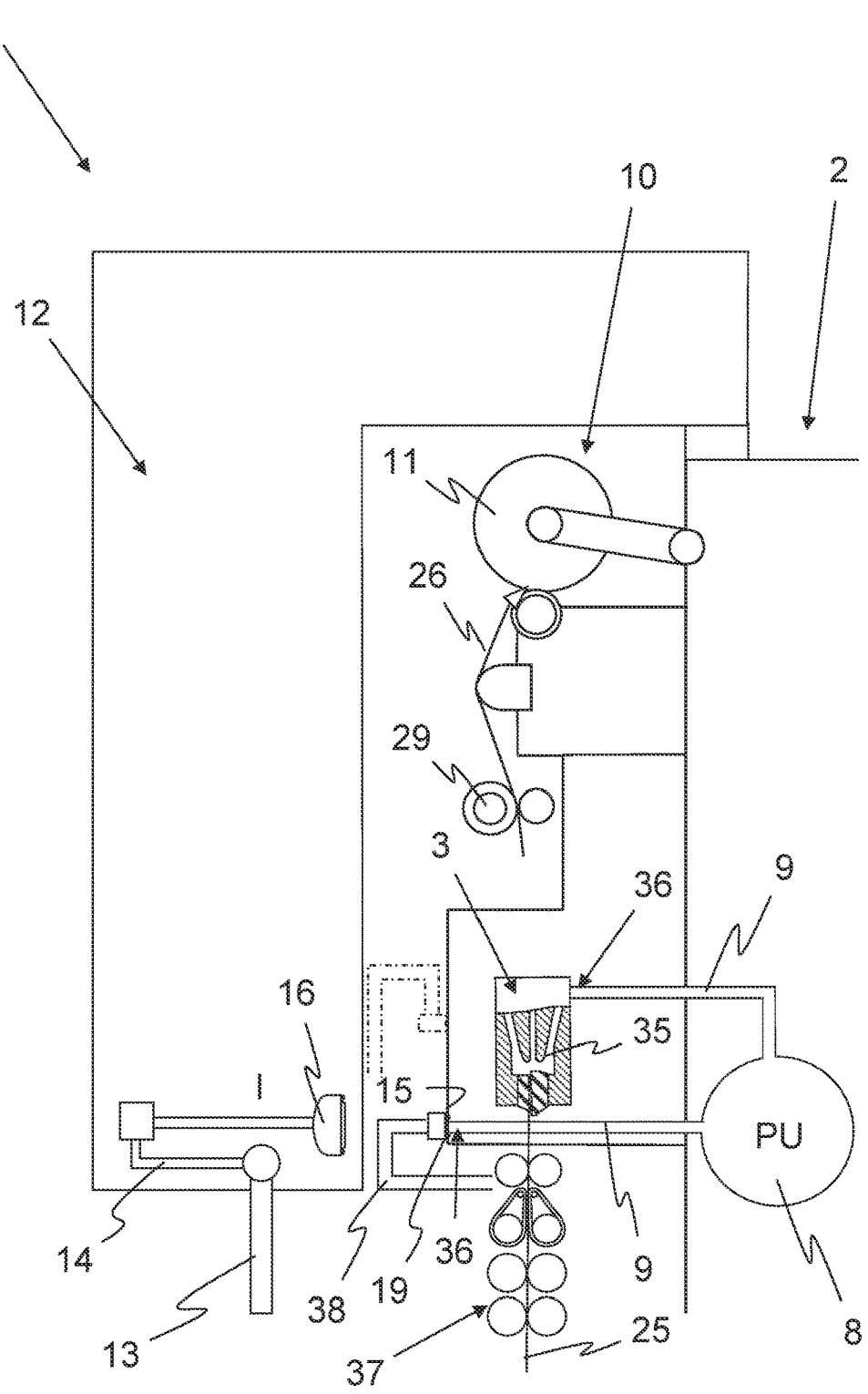
FIG. 7 shows a schematic side view of a workstation of a spinning machine designed as an air-jet spinning machine and of a maintenance unit positioned in front of the workstation.

The spinning machine 1 shown in the present case is designed as an open-end spinning machine, specifically as a rotor spinning machine in this case. The invention is also usable, however, with other spinning machines 1 that require a process vacuum PU for the spinning process. Friction spinning machines and air-jet spinning machines, in particular, are conceivable. An air-jet spinning machine is shown in FIG. 7

Moreover, the spinning machine 1 comprises a maintenance unit 12, which is displaceable along the workstations 2 and includes at least one pneumatic working element 13 and at least one vacuum line 14 for supplying the pneumatic working element 13 with vacuum. The pneumatic working element 13 can be, for example, a suction tube for picking up a thread end or also a sliver end 27 (see FIG. 5), or also a pneumatic thread store.

In order to supply the pneumatic working element 13 with vacuum, it is now provided to supply the pneumatic working element 13 with process vacuum directly via the spinning device 3. For this purpose, a suction head 16 of the maintenance unit 12 is advanced toward a connection opening 15 of the spinning device 5, with the aid of which the pneumatic working element 13 is supplied with process vacuum PU. For this purpose, the connection openings 15 are connected to the process vacuum PU, for example, via one further tap line 9. The suction head 16 of the maintenance unit 12 is connected to the vacuum line 14 for this purpose and can be advanced toward the connection openings 15.

According to the present example, the connection openings 15 are designed as independent openings of the spinning device 3, i.e., they are provided at the spinning devices 3 explicitly and exclusively for the supply of the maintenance unit 12 with vacuum. Alternatively, openings that are present anyway and are connected to the process vacuum PU can also be utilized for supplying the maintenance unit 12, however, as explained with reference to FIGS. 2 through 4 and 6. On an air-jet spinning machine, such an independent connection opening 15 could also be provided at the spinning device 3 close to the spinning chamber. It would also be conceivable, however, to provide such a connection opening 15 at the suction nozzles of the drafting system.

Figure 2:
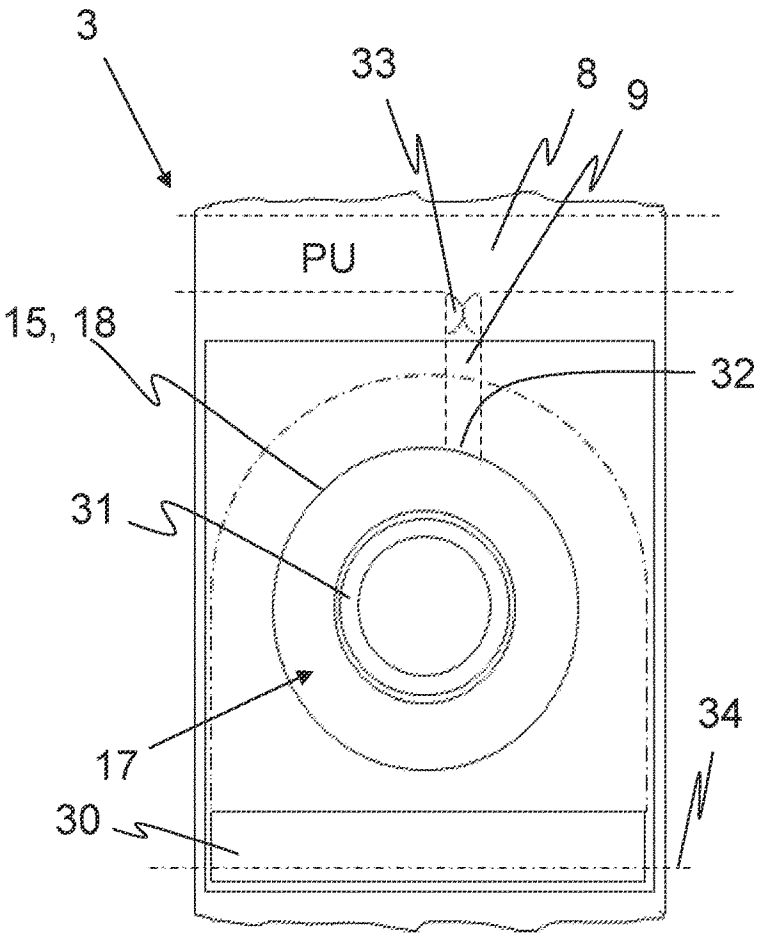
FIG. 2 shows a front view of a spinning device comprising a connection opening, which is closeable with the aid of a cover element.

FIG. 2 shows a schematic front view of a spinning device 3, which is designed as a rotor spinning device. The spinning device 3 comprises a rotor housing 17, in which a spinning rotor 31 is accommodated. Moreover, the rotor housing 17 comprises an opening 18, which is closed by a cover element 30 during the spinning operation. The cover element 30 can swivel about a swivel axis, in order to open and close the opening 18 of the rotor housing 17. The cover element 30 is shown, with the aid of dash-dotted lines, in a closed state, in which it closes the opening 18 of the rotor housing 17. With the aid of solid lines, on the other hand, the cover element 30 is represented in its state folded away from the rotor housing 17. Moreover, the rotor housing 17 comprises a suction opening 32, which connects it to the vacuum duct 8 via the tap line 9. The suction opening 32 can be closed with the aid of a valve 33. As a result, the spinning device 3 can be disconnected from the process vacuum PU when the spinning device 3 is not operating. In the present case, the valve 33 is represented in the closed state.

In the present example, which differs from that shown in FIG. 1, the connection opening 15 is formed directly by the opening 18 of the rotor housing 17. This embodiment has the advantage that no changes of the workstations 2 are necessary in order to supply the pneumatic working element 13 of the maintenance unit 12, since the opening 18 of the rotor housing 17 is present anyway and can be utilized, without changes, for supplying the maintenance unit 12 with vacuum. In this case, the suction head 16 (see FIG. 3) is designed for being connected to the opening 18 of the rotor housing 17 and is adapted to its size.

Figure 3:
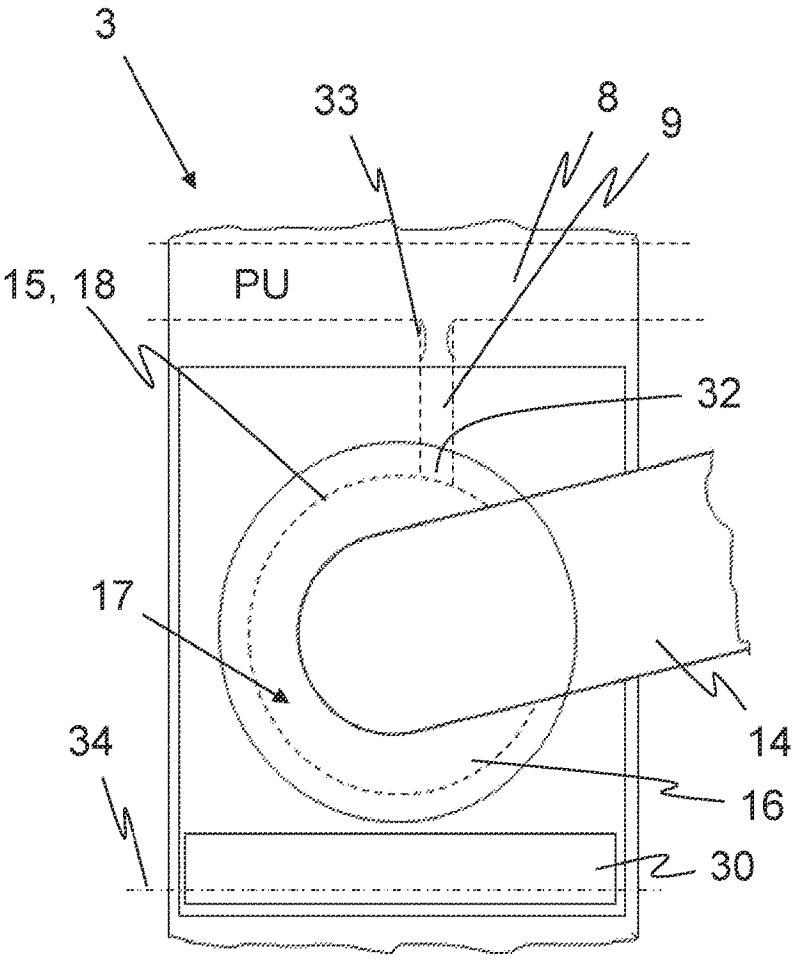
FIG. 3 shows a front view of a spinning device comprising a connection opening, which is closeable with the aid of a cover element, and an advanced suction head.

FIG. 3 shows a spinning device 3, in the case of which the suction head 16 of the maintenance unit 12 has already been advanced toward the opening 18 of the rotor housing 17. The cover element 30 has been swiveled away for this purpose, which can take place either with the aid of the maintenance unit 12 or with the aid of the workstation 2 or the spinning device 3 itself. As is apparent from FIG. 3, the suction head 16 completely covers the opening 18 of the rotor housing 17 or the connection opening 15, so that a vacuum loss or the drawing-in of false air from the surroundings is avoided. The valve 33 is now open, in order to allow for the vacuum supply—via the suction opening 32 of the rotor housing 17—of the maintenance unit 12 via the suction head 16 and the vacuum line 14.

Figure 4:
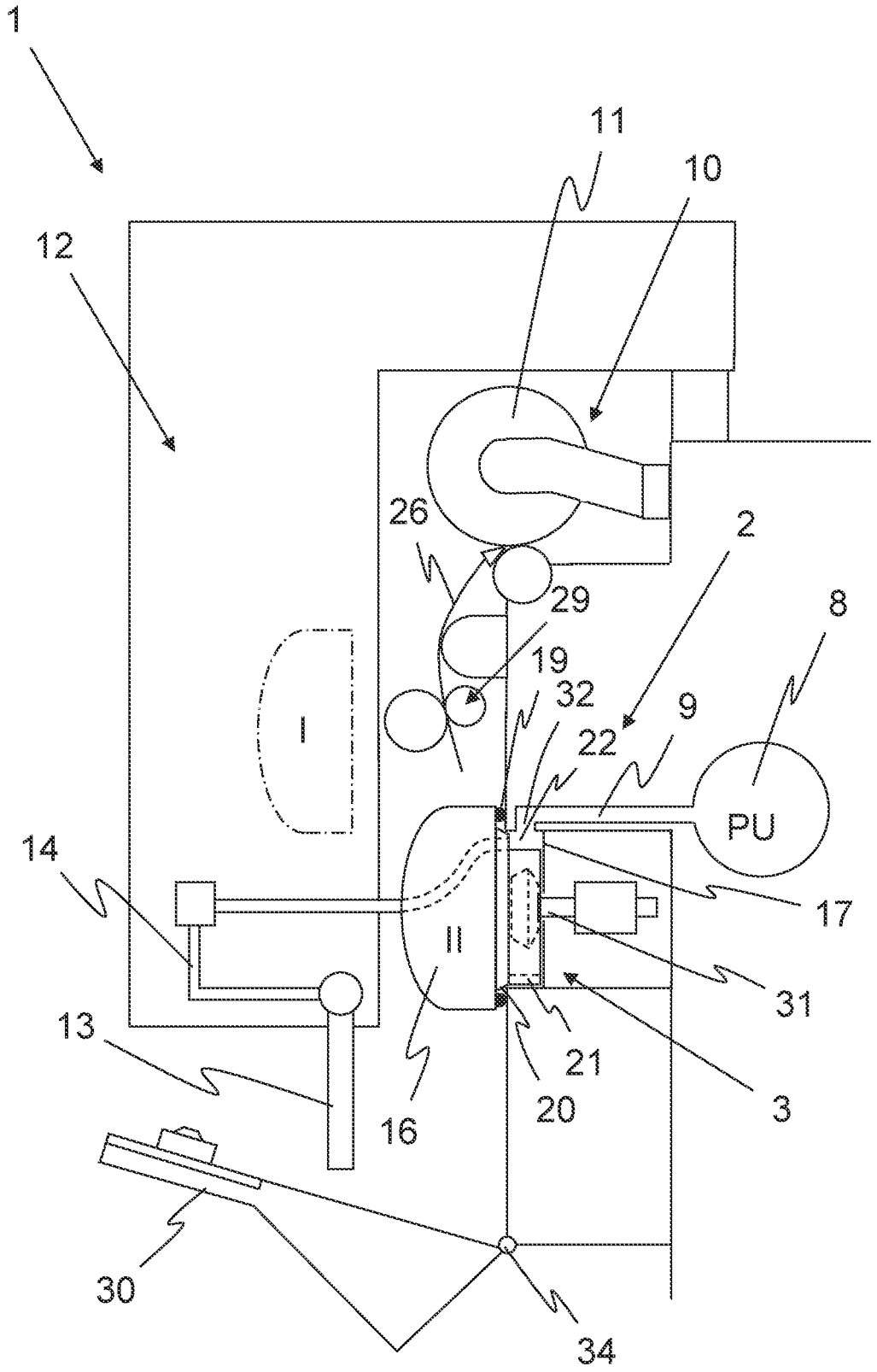
FIG. 4 shows a schematic side view of a workstation of a spinning machine and of a maintenance unit positioned in front of the workstation.

FIG. 4 shows a schematic, partial cutaway side view of a workstation 2 of a spinning machine 1. A maintenance unit 12 is positioned in front of the workstation 2, in order to carry out a maintenance action at the workstation 2. The individual components and parts of the workstation 2 as well as of the maintenance unit 12 largely correspond to those of FIG. 1 and will not be further explained at this point.

As described above, the maintenance unit 12 comprises a pneumatic working element 13, which is supplied with process vacuum PU via the vacuum line 14 and the opening 18 of the rotor housing 17. In the situation shown in the present case, the cover element 30 has already been swiveled away and the suction head 16 of the maintenance unit 12 has already been advanced toward the opening 18 of the rotor housing 17. In the present example, the suction head 16 is movable from a neutral position I, in which it is arranged in a protected manner in the interior of the maintenance unit 12, into a working position II, in which it has been advanced toward the opening 18 of the rotor housing 17. The movement can take place, in any manner, via a linear movement, a swivel movement, or a combined movement, which can be advantageously brought about with the aid of a pneumatic cylinder (not represented here). As soon as the suction head 16 has been advanced toward the opening 18 of the rotor housing 17 or toward the connection opening 15 and an optionally present valve 33 (not represented here) has been opened, the pneumatic working element 13 can be supplied with the process vacuum PU.

In order to seal the connection opening 15 toward the outside and avoid vacuum losses during the supply of the pneumatic working element 13, the connection opening 15 is sealed with the aid of a sealing element 19. In the present case, the sealing takes place with the aid of the sealing element 19, which is arranged anyway at the opening 18 of the rotor housing 17 and seals the rotor housing 17 in cooperation with the cover element 30 during the operation of the spinning device 3. During the supply of the working element 13 with vacuum, on the hand, the suction head 16 cooperates with the sealing element 19 of the spinning device 3, in order to seal the rotor housing 17. For this purpose, the suction head 16 is placed onto the sealing element 19, for example, with the aid of the above-described pneumatic cylinder(s) or also other actuating units, and is pressed against the sealing element 19.

Moreover, according to the present example, the suction head 16 comprises a centering element 20, in order to correctly position the suction head 16 with respect to the connection opening 15, which is not labeled in FIG. 4 for the sake of clarity. In the present case, the centering element 20 is designed as a centering cone and engages into the opening 18 of the rotor housing 17 or into the connection opening 15 for the purpose of centering.

Moreover, the suction head 16 shown in the present case also comprises a cover element 21. This is designed separately from the centering element 20 in the present case and is utilized for protecting the spinning rotor 31 against damage by the suction head 16 and against contamination by materials that may have been drawn off. In the working position II of the suction head 16, the cover element 21 completely covers the spinning rotor 31 and leaves only a narrow passage opening 22 open in an edge area of the rotor housing 17. This allows for the removal of materials, which have been carried through via the vacuum line 14, via the suction opening 32 and the tap line 9 into the vacuum duct 8. The passage opening 22 is formed by a recess of the cover element 21 in the present case.

Figure 5:
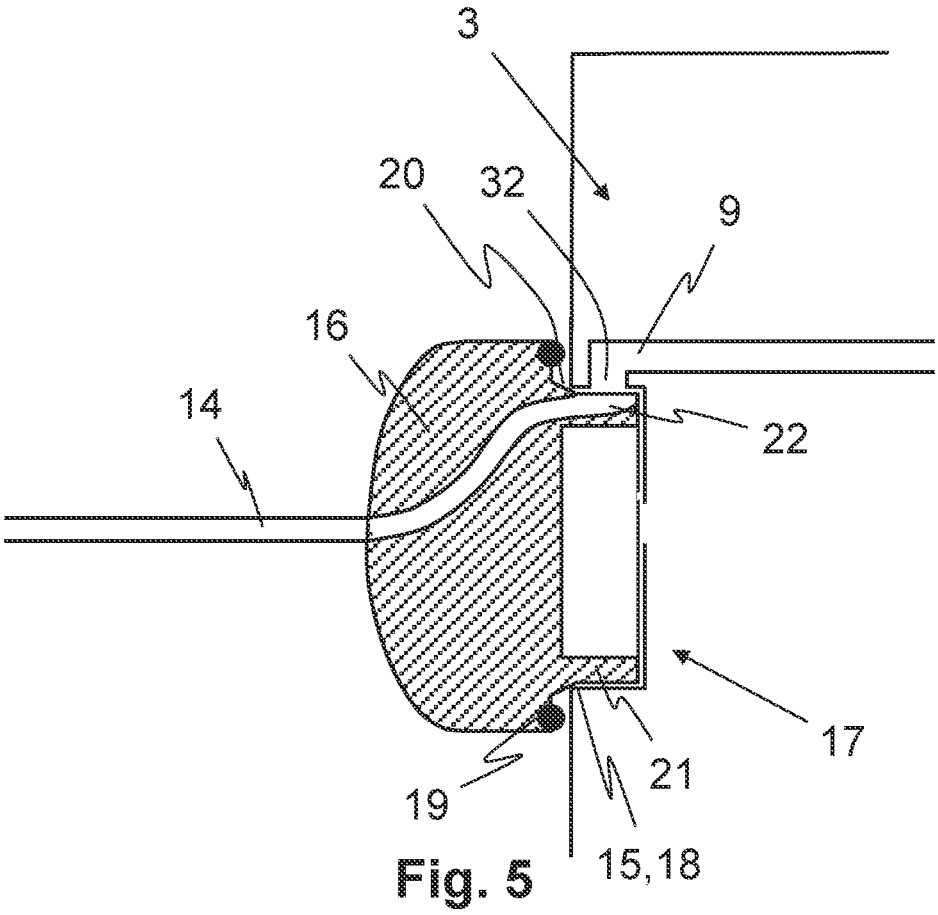
FIG. 5 shows a detailed view of a rotor housing comprising a suction head advanced toward the opening of the rotor housing, in a schematic, partial cutaway side view.

FIG. 5 shows such a suction head 16 comprising a passage opening 22 in a schematic, cutaway detailed representation. The spinning rotor 31 is not represented in FIG. 5 for the sake of clarity. The passage opening 22 is designed in the form of a passage duct within the cover element 21 in this case.

Of course, the embodiments of the suction head 16 shown in FIGS. 4 and 5 are to be understood merely by way of example. For example, the vacuum line 14 does not necessarily need to be connected to the suction head 16 in the center. Likewise, the centering element 20 and the cover element 21 can also be formed completely as one piece with one another. A cover element 21 is also not absolutely necessary, depending on which function the pneumatic working element 13 performs and exactly where the connection opening 15 is located.

Figure 6:
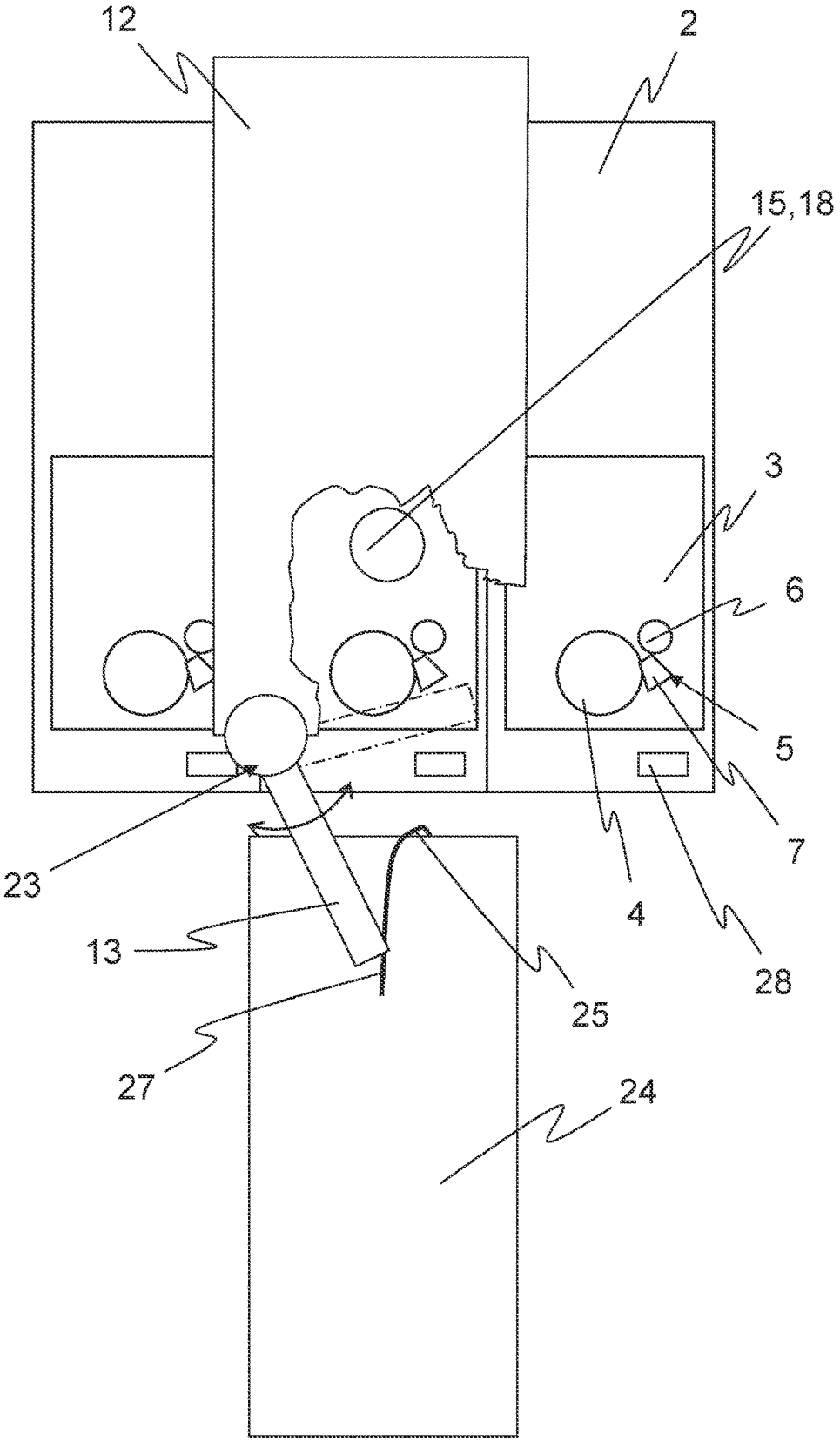
FIG. 6 shows a front view of a workstation of a spinning machine comprising a maintenance unit positioned in front thereof and containing a sliver feeding device.

FIG. 6 shows a front view of a maintenance unit 12 comprising a pneumatic working element 13, which is designed as a sliver feeding device 23. The pneumatic working element 13 is a suction tube in this case, which is movably arranged at the maintenance unit 12, as indicated by the double arrow. If the sliver 25 has been torn at a spinning device 3, or if the sliver 25 stored in the can 24 associated with the particular workstation 2 has run out, it is necessary to pick up a new sliver end 27 from the can 24 and feed it to the spinning device 3 or to the feeding device 5 again.

For this purpose, after the emptied can 24 has been replaced, if necessary, by a full can 24, the maintenance unit 12 is positioned in front of the relevant workstation 2, which is the middle of the three represented workstations 2 in the present case. Thereafter, the cover element 30 is opened, which can take place either with the aid of the maintenance unit 12 or with the aid of the workstation 2 itself. The cover element 30 is not represented here, for the sake of clarity. Thereafter, as described above with reference to FIG. 4, the suction head 16 is moved out of its neutral position I into the working position II, in order to dock the suction head 16 to the connection opening 15, which is also formed by the opening 18 of the rotor housing 17 in this case. Since the workstation 2 is stopped when a sliver 25 breaks or runs out, the valve 33 in the suction opening 32 (see FIGS. 2 and 3) is closed at this point in time.

As soon as the suction head 16 has docked to the connection opening 15, the valve 33 can be opened, in order to provide the process vacuum PU to the pneumatic working element 13. In order to seek the sliver end 27, the suction tube or the pneumatic working element 13 is now swiveled back and forth until the sliver end 27 is located and drawn in by the suction tube. In order to facilitate the location of the sliver end 27, when cans 24 are full, the sliver end 27 is usually placed over the edge of the can 24. If the sliver 25 has been torn, a sliver end 27, which is located in the interior of the can 24, must be placed, by an operator, over the edge of the can 24 again. After the sliver end 27 has been picked up by the working element 13, the working element 13 is swiveled again, as indicated by the dash-dotted line, and, as a result, is guided to the feeding device 5. Provided a loop-catching means 28 is arranged at the workstation 2, the sliver end 27 can also be placed into the loop-catching means 28 directly with the aid of the pneumatic working element 13.

The sliver feeding device 23 can also comprise multiple pneumatic working elements 13 or also other, non-pneumatic handling units. One or multiple additional working element(s) 13 or handling units can also be present, for example, in order to thread the sliver 25 or the sliver end 27 into the loop-catching means 28. Moreover, it is advantageous when the picked-up sliver end 27 is initially trimmed to a defined length and is thinned out before it is supplied to the feeding device 5. The trimming and thinning, as well as the feeding to the feeding device 5, can take place with the aid of the pneumatic working element 13, namely the suction tube in this case, as well as with the aid of one further pneumatic working element 13 or one further handling unit.

If the sliver end 27 is trimmed before the feeding to the feeding device 5, a detached sliver piece arises. This can be sucked in by the pneumatic working element 13 and drawn into the vacuum duct 8 via the vacuum line 14, as also described above with reference to FIG. 4.

After the sliver end 27 has been supplied to the feeding device 5 and the detached sliver piece has also been sucked away, if necessary, the valve 33 is closed again and the suction head 16 is moved back into its neutral position I. The cover element 30 of the spinning device 3 is closed and the maintenance unit 12 leaves the workstation 2. The relevant workstation 2 can now restart its regular production.

FIG. 7 shows a schematic side view of a workstation 2 of a spinning machine 1 designed as an air-jet spinning machine. In the case of such an air-jet spinning machine, the spinning device 3 of each workstation 2 comprises a spinning chamber 35, in which the supplied sliver 25 is spun into a yarn with the aid of compressed air. Moreover, the spinning chamber 35 is provided with a suction connection 36, via which it can be acted upon with a process vacuum PU. In order to feed or supply the sliver 25 to the spinning device 3, a drafting system 37, in which a presented sliver 25 is already drafted, is provided at each of the workstations 2 in this case. Preferably, a suction nozzle 38 is associated with the drafting system 37 at each workstation 2, with the aid of which loose fibers are extracted. The suction nozzle 38 is also connected to the process vacuum PU via a suction connection 36. In order to supply the spinning chambers 35 and/or the suction nozzles 38 of the individual workstations 2, a vacuum duct 8 extending along the workstations 2 is also provided in the case of the air-jet spinning machine. The process vacuum PU is applied to each of the spinning devices 3 or the spinning chambers 35 and/or also each of the suction nozzles 38 via a tap line 9 branching off from the vacuum duct 8.

In the present case, the suction nozzle 38 is arranged at the workstation 2 in such a way that it can be folded away. The suction nozzle 38 is represented in its position during the spinning operation with the aid of solid lines, while the folded-away position is represented with the aid of dash-dotted lines. If the suction nozzle 38 has been folded away, the suction connection 36, which is also provided with a sealing element 19 in the present case, is free and can be utilized as a connection opening 15 for the maintenance unit 12.

Alternatively to the representation shown, it would also be conceivable, however, to utilize the suction connection 36 of the spinning chamber 35 for the vacuum supply of the maintenance unit 12.

The present invention is not limited to the represented and described exemplary embodiments. Modifications within the scope of the claims are also possible, as is any combination of the described features, even if they are represented and described in different parts of the description or the claims or in different exemplary embodiments, provided no contradiction to the teaching of the independent claims results.

LIST OF REFERENCE NUMBERS

1. spinning machine
2. workstation
3. spinning device
4. opening roller
5. feeding device
6. feeding roller
7. feed trough
8. vacuum duct
9. tap line
10. winding device
11. package
12. maintenance unit
13. pneumatic working element
14. vacuum line
15. connection opening
16. suction head
17. rotor housing
18. opening
19. sealing element
20. centering element
21. cover element
22. passage opening
23. sliver feeding device
24. can
25. sliver
26. yarn
27. sliver end
28. loop-catching means
29. take-off device
30. cover element
31. spinning rotor
32. suction opening
33. valve
35. spinning chamber
36. suction connection
37. drafting system
38. suction nozzle
I neutral position
II working position
PU process vacuum

The invention claimed is:

1. A spinning machine, comprising: a plurality of adjacently arranged workstations, each workstation comprising a spinning device to which a process vacuum is applied during spinning operation;

an internal vacuum system that provides the process vacuum for the workstations;

the vacuum system comprising a vacuum duct extending along the workstations for supplying the spinning devices with the process vacuum;

a maintenance unit that is displaceable along the workstations, the maintenance unit comprising a pneumatic working element and a vacuum line to supply the pneumatic working element with vacuum;

a closeable connection opening at each of the spinning devices;

the maintenance unit comprising a suction head that is advanceable toward the connection opening and is connected to the vacuum line to place the pneumatic working element in communication with the process vacuum supplied by the internal vacuum system of the spinning machine; and the pneumatic working element comprising a suction tube configured to pick up a thread end or sliver end or comprising a pneumatic thread store, the pneumatic working element utilizing the process vacuum supplied by the vacuum line via connection of the suction head with the closeable connection.

2. The spinning machine as in claim 1, wherein the spinning device is as an air-jet spinning device comprising a spinning chamber to which the process vacuum is applied.

3. The spinning machine as in claim 1, wherein the spinning device is a rotor spinning device comprising a rotor housing.

4. The spinning machine as in claim 3, wherein the connection opening is configured in the rotor housing and is closeable by a cover element.

5. The spinning machine as in claim 1, wherein the suction head is movable out of a neutral position into a working position to be advanced toward the connection opening.

6. The spinning machine as in claim 5, wherein in the working position the suction head completely covers the connection opening.

7. The spinning machine as in claim 6, wherein in the working position the suction head cooperates with a sealing element of the spinning device to seal the connection opening.

8. The spinning machine as in claim 1, wherein the suction head comprises a centering element to aid in centering the suction head with respect to the connection opening.

9. The spinning machine as in claim 1, wherein the spinning device is a rotor spinning device comprising a rotor housing, the suction head comprising a cover element that covers a spinning rotor arranged in the rotor housing in a working position of the suction head.

10. The spinning machine as in claim 9, wherein the cover element comprises a passage opening that connects the vacuum line of the maintenance unit to a suction opening of the rotor housing in the working position of the suction head.

11. The spinning machine as in claim 1, wherein the pneumatic working element is configured as a sliver feeding device or a component of a sliver feeding device.

12. A method for supplying a pneumatic working element of a maintenance unit of a spinning machine with vacuum, wherein the spinning machine comprises a plurality of adjacently arranged workstations that each include a spinning device to which a process vacuum is applied, the maintenance unit displaceable along the workstations, the method comprising:

supplying the pneumatic working element with the process vacuum via a suction head of the maintenance unit, wherein the suction head is advanced toward a closeable connection opening of the spinning device; and supplying the process vacuum to the spinning devices from a vacuum system that is internal to the spinning machine and that supplies all of the workstations with the process vacuum via a vacuum duct.

13. The method as in claim 12, the spinning device is a rotor spinning device comprising a rotor housing, the pneumatic working element supplied with the process vacuum via an opening of the rotor housing.

14. The method as in claim 12, comprising sealing the connection opening against vacuum loss with a sealing element during the supply of the pneumatic working element with the process vacuum.

15. A method for supplying a pneumatic working element of a maintenance unit of a spinning machine with vacuum, wherein the spinning machine comprises a plurality of adjacently arranged workstations that each include a spinning device to which a process vacuum is applied, the maintenance unit displaceable along the workstations, the method comprising:

supplying the pneumatic working element with the process vacuum via a suction head of the maintenance unit, wherein the suction head is advanced toward a closeable connection opening of the spinning; and comprising using the pneumatic element to pick up a sliver end and feed the sliver end to a feeding device or to a drafting system of the spinning device.

16. The method as in claim 15, comprising trimming the picked-up sliver end before feeding the sliver end to the spinning device or the drafting system, wherein a detached sliver piece is produced by the trimming.

17. The method as in claim 16, comprising extracting the detached sliver piece via the suction head and the connection opening.

18. The method as in claim 17, wherein the spinning device is a rotor spinning device comprising a rotor housing, the pneumatic working element supplied with the process vacuum via the connection opening of the rotor housing, the detached sliver piece extracted via the connection opening of the rotor housing and a suction opening of the rotor housing.

19. The method as in claim 18, wherein the detached sliver piece is transported to a machine end of the spinning machine for disposal.

20. The method as in claim 16, wherein the detached sliver piece is deposited in a collection container with the aid of the pneumatic working element.

21. The method as in claim 20, wherein the detached sliver piece is transferred from the collection container to an empty can or a transport vehicle.

* * * * *